United States Patent [19]

Beermann et al.

[11] 4,038,924

[45] Aug. 2, 1977

[54] IGNITER FOR FUSES AND THE LIKE

[75] Inventors: Paul Beermann, Lendringsen; Wilhelm Grosse-Benne, Menden; Hans Guntermann, Essen-Steele; Johann-Hugo Wirtz, Essen-Bredeney, all of Germany

[73] Assignee: Hagenuk & Co GmbH, Menden, Germany

[21] Appl. No.: 559,157

[22] Filed: Mar. 17, 1975

[30] Foreign Application Priority Data

Mar. 19, 1974 Germany ..... 7409502[U]

[51] Int. Cl.[2] ..... F42C 15/00

[52] U.S. Cl. ..... 102/70 S; 102/86.5; 89/1 B

[58] Field of Search ..... 102/70 S, 70 R, 86.5, 102/45, 27 F; 89/1 B

[56] References Cited

U.S. PATENT DOCUMENTS

| | | | |
|---|---|---|---|
| 1,311,740 | 7/1919 | Asbury | 102/70 S |
| 2,051,331 | 8/1936 | De Bobula | 102/70 R X |
| 2,375,522 | 5/1945 | Campbell | 102/70 S |
| 2,926,607 | 3/1960 | Muller et al. | 102/86.5 X |
| 3,260,206 | 7/1966 | Beermann et al. | 102/70 R |
| 3,596,601 | 8/1971 | Kolf | 102/70 S |
| 3,817,181 | 6/1974 | Persson et al. | 102/29 |
| 3,901,155 | 8/1975 | Huber | 102/70 R |

FOREIGN PATENT DOCUMENTS

| | | | |
|---|---|---|---|
| 1,245,819 | 7/1967 | Germany | 102/70 R |

*Primary Examiner*—David H. Brown
*Attorney, Agent, or Firm*—Michael J. Striker

[57] ABSTRACT

A firing cap is located in a housing and produces, when detonated, a fuse-igniting fire jet. A firing pin mechanism is provided for impacting and detonating the firing cap. An arrangement is provided which extends across the path of the fire jet and which includes passages through which the jet is compelled to pass to thereby control the behavior of the jet.

11 Claims, 8 Drawing Figures

FIG. 1
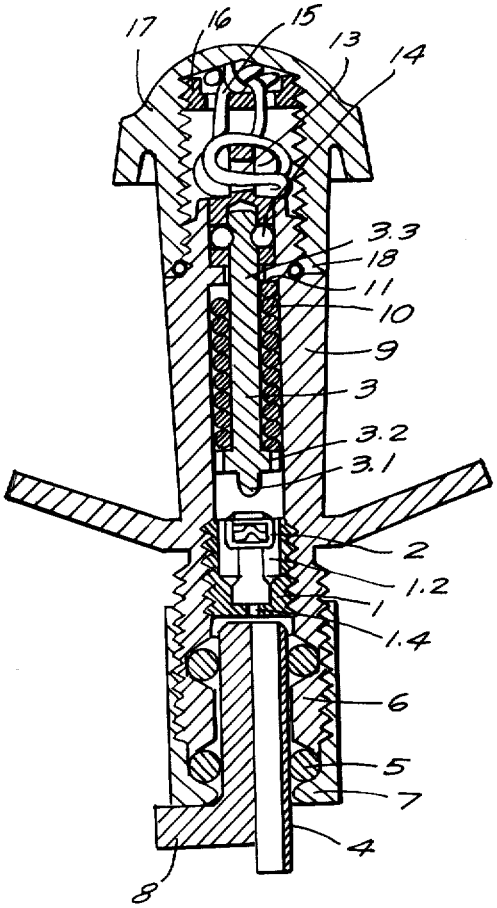
FIG. 2
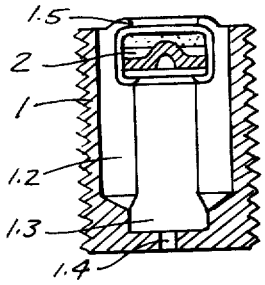
FIG. 3
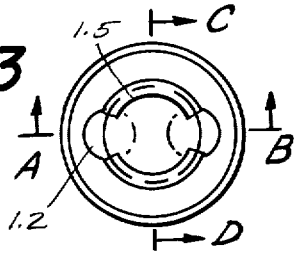
FIG. 4
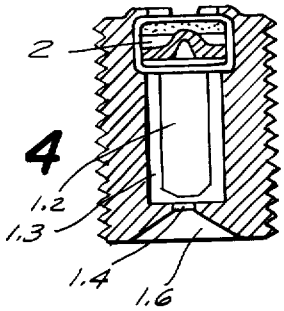
FIG. 8
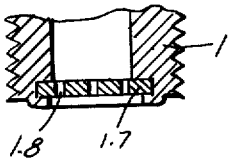
FIG. 5
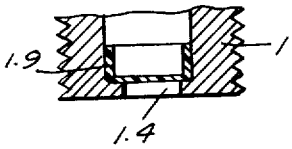
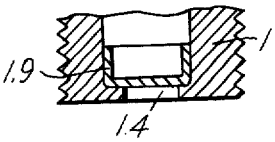
FIG. 6
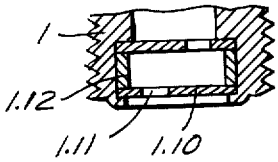
FIG. 7

IGNITER FOR FUSES AND THE LIKE

BACKGROUND OF THE INVENTION

The present invention relates to an igniter for fuses and the like.

The igniters for fuses and delay fuses are well known in a variety of types. Many of these are so constructed that a user pulls a cord or pin, thereby releasing a firing mechanism which causes a firing pin to forcefully impact a firing cap. This firing cap detonates, producing a flame or fire jet which sets fire to the fuse or delay fuse.

Many of these devices have a very complicated internal mechanism which makes them not only expensive to produce but also contributes to the possibility of malfunction. More importantly, however, all these igniters of the prior art have the disadvantage that the capacity of ignition exists only for a limited time, which is essentially the result of the composition of the firing cap, i.e., the chemical composition thereof. It is known, for example, from German Pat. No. 1,213,326 to provide a firing cap which operates very well but which has a life of only approximately three years, whereupon the constituents of the firing cap can no longer be relied upon to detonate.

SUMMARY OF THE INVENTION

It is a general object of this invention to provide an improved igniter for fuses and the like which has a considerably longer lifetime than those known from the prior art, even under extreme climatic conditions.

A further object of the invention is to provide such an igniter wherein the firing cap is water-tightly mounted and which affords high accuracy of ignition of the fuse or delay fuse.

Another object of the invention is to provide such an igniter wherein the fire jet resulting from ignition of the firing cap is well controlled.

In keeping with these objects, and with others which will become apparent hereafter, one feature of the invention resides in an igniter for fuses and the like which, briefly stated, comprises a housing, a firing cap in the housing for producing, when detonated, a fuse-igniting fire jet, and a firing pin mechanism for impacting and detonating the firing cap. Means extends across the path of the fire jet and includes passage means through which the jet is compelled to pass, for controlling the fire jet. At least one gas-venting opening is arranged laterally of the firing cap.

The present invention provides for the use of an anvil-type firing cap having a charge whose composition assures grade uniformity of operation from firing cap to firing cap. Furthermore, the composition of the charge is absolutely free of any quicksilver, which is used in many other firing caps, and this eliminates some other prior-art disadvantages, such as the quicksilver web vapors which are frequently found undesirable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a partial axial section through an igniter according to the present invention;

FIG. 2 is a section taken on line A–B of FIG. 3;

FIG. 3 is a top-plan view of FIG. 2;

FIG. 4 is a section taken on line C–D of FIG. 3;

FIG. 5 is a fragmentary axial section analogous to FIG. 2, but illustrating a further embodiment;

FIG. 6 is a view similar to FIG. 5, illustrating an additional embodiment of the invention;

FIG. 7 is a view similar to FIG. 6, illustrating still a further embodiment of the invention and FIG. 8 is a view similar to FIG. 5, illustrating yet another embodiment of the invention.

DESCRIPTION OF THE PREFERRED EMBODIMENTS

Discussing the drawing now in detail, and referring firstly to FIGS. 1–4, it will be seen that reference numeral 9 identifies a housing having an internal bore in which a firing pin 3 is slidably received. The firing pin 3 is permanently biased towards impacting an anvil-type firing cap 2 with its tip 3.1. The spring 10 bears upon a shoulder adjacent the lower end 3.1 of the firing pin 3 and upon an abutment 11 extending into the bore of the housing 9. The shoulder of the firing pin 3 against which the spring 10 bears is provided with a plurality of gas-venting openings 3.2. The upper end of the firing pin 3 is held in the region 3.3 by two rounded cylindrical pins or else spherical members 14, which are mounted in a pull-off frame 13 in which also the rip cord 15 is secured. The rip cord 15 is connected with a holding disc 16 by means of a knot, and disc 16 is threaded into the pull-off head 17. In use, the head 17 is initially threaded off and thereupon pulled away from the housing 9. This pull force is transmitted via ripcord 15 to the frame 13. Thus, the members 14 which hold the pin 3 in the illustrated position will be pulled over the upper end of pin 3. Since members 14 are now disengaged from and no longer hold the pin 3, this pin is free to impinge against cap 2 by virtue of the restoring action of the permanently-biased spring 10. An O-ring 18 is provided to water-tightly seal the junction between housing 9 and head 17.

The firing cap 2 is mounted in the firing cap carrier 1. It is securely connected with the firing cap carrier 1 by bent-over portions 1.5 so that the gas pressure which develops in response to detonation of the firing cap 2 cannot loosen the firing cap from the carrier 1. The carrier 1 is provided with gas-venting openings 1.2 laterally of a bore 1.3 downwardly of which there is located a passage 1.4. FIG. 4 shows that the passage 1.4 may be followed by a diverging passage portion 1.6. A clamping sleeve 7 is provided, having a spacer 6 with tapered ends and an O-ring 5 which serve to clamp a fuse 4 in place which is to be ignited by detonation of the firing cap 2. Before the fuse 4 is installed, a plug 8 is put in place to water-tightly close this lower end of the device.

FIG. 5 shows a different embodiment wherein the firing cap carrier 1 is provided with an apertured disc 1.7 having bores 1.8 therein.

FIG. 6 shows a further embodiment in which a cup-shaped member 1.9 of synthetic plastic foil, metallic foil or metallic mesh material is mounted in the firing cap holder 1 across the opening 1.4, but so dimensioned as to leave sufficient space between its outer wall and the inner wall bounding the bore 1.3 so that a communication exists between the bore 1.3 and the opening 1.4.

Still another embodiment is shown in FIG. 7 in which a bore 1.3 has installed in it two apertured plates 1.10 having holes 1.11 which are so offset relative to one another that the fire jet resulting from ignition of the firing cap 2 cannot directly impinge the adjacent end of the fuse 4 (compare FIG. 1) but instead must travel through a tortuous path. A spacer ring 1.12 is provided to maintain the plates 1.10 axially spaced from one another.

The charge of the firing cap 2 is essentially composed of lead trinitro resorcinate. It cannot rust even over a prolonged shelf-life and even a direct and prolonged exposure to conditions of high moisture, for example due to rain, dew, snow or the like, cannot adversely influence the detonating ability of the firing cap 2. Even under the most adverse climatic conditions, the device according to the present invention, and of course as its central part the firing cap 2, is absolutely certain to operate. Tests have shown that even in the event of fog, extremely cold temperatures, extremely hot and humid conditions, or in dry heat, the operating capability of the device is not adversely influenced at all. Firing caps of the type described herein, that is anvil-type firing caps have previously been tried in igniters of the type here in question. However, they have never been successfully used because they produce a very strong fire jet when they are detonated, and this always used up the available oxygen within the confines of the igniter so rapidly that it was not possible to bring the fuse to a burn. As a result, the fuses were merely charred by the firing jet which had consumed the available oxygen, but would not burn and the device therefore did not achieve its intended purpose.

This problem is avoided in the device according to the present invention due to the passages 1.4 and 1.6, or their equivalent in the other embodiments, the fire jet originating upon detonation of the firing cap 2 is strongly reduced or braked, so that only a small part of the jet impinges the adjacent end of the fuse 4, or the delay fuse, so that sufficient oxygen remains in the vicinity of the fuse for the fire jet to cause the fuse to start burning.

To assure a proper venting of the gases resulting from detonation of the firing cap, a plurality (e.g., two or more) gas venting openings 1.2 are provided laterally of the firing cap 2 which divert and vent the high gas pressure developing upon detonation of the firing cap, upwardly into the housing 9. Corresponding openings are formed in the shoulder of the firing pin 3, identified with reference numeral 3.2 as pointed out earlier.

In the case of the embodiment of FIG. 6, where the cupped member 1.9 is made of foil or the like, it should be of a readily combustible synthetic plastic material or of a thin-walled material of another type, for example metal or the like, as shown in the embodiment of FIG. 8, but in any case it serves the purpose of reducing the fire jet in the necessary manner. In FIG. 6 the member 1.9 is cup-shaped, but it could also have a different shape. If it is of a readily combustible synthetic plastic material, then it will be consumed upon impingement by the fire jet and the fire jet will then pass through the opening 1.4, being sufficiently controlled (i.e., braked or retarded) that it is not capable of consuming the oxygen in the vicinity of that end of the fuse 4 which is to be started burning.

Water-tight mounting of the firing cap is a particular requirement in igniters which are used for military applications.

The components of the igniter according to the present invention may be of metallic material or of synthetic plastic materials, in which latter case the synthetic materials must be capable of withstanding impacts and large temperature fluctuations.

The igniter according to the present invention is simple and highly reliable in its operation, and is very inexpensive to produce, especially if the majority of least its larger outer components, such as the housing, is made of synthetic plastic material.

It will be understood that each of the elements described above, or two or more together, may also find a useful application in other types of constructions differing from the types described above.

While the invention has been illustrated and described as embodied in an igniter for fuses and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A water-tight igniter for fuses and the like, comprising a housing; a firing cap in said housing for producing, when detonated, a fuse-igniting fire jet; a firing pin mechanism at one side of said firing cap for impacting and detonating the latter; a fuse at the other side of said firing cap; deflecting means extending across the path of said fire jet and including passage means through which the jet is compelled to pass, for controlling the fire jet and for directing the latter towards said fuse so as to ignite the same; at least one gas-venting opening laterally of said firing cap; and means for mounting said fuse on said housing in water-tight condition, including a plug surrounding said fuse, a sleeve surrounding said plug and mountable on said housing, and sealing means intermediate said plug and said sleeve for preventing access of water into the interior of said housing, so as to maintain said firing cap moisture-proof.

2. Igniter as defined in claim 1, wherein said passage means is formed by a plurality of narrow bores.

3. Igniter as defined in claim 1, wherein said passage means is formed by at least one narrow bore.

4. Igniter as defined in claim 1, wherein said deflecting means comprises a plate provided with a plurality of narrow holes which form said passage means.

5. Igniter as defined in claim 1, wherein said deflecting means comprises two axially spaced plates each provided with holes and a spacer ring between said plates, said holes constituting said passage means and having relative positions selected to impose upon said fire jet a tortuous path.

6. Igniter as defined in claim 1; and further comprising a clamping element mounted in said sleeve, and wherein said sealing means comprises an O-ring having one side facing said housing and its other side facing said clamping element; and also comprising means for moving said sleeve together with said clamping element relative to said housing so as to clamp said O-ring between said housing and said clamping element.

7. Igniter as defined in claim 1, wherein said sleeve is threadedly connected with said housing.

8. Igniter as defined in claim 1, wherein said deflecting means comprises an element of sheet-material arranged in said passage means.

9. Igniter as defined in claim 8, wherein said element has a cup-shaped configuration.

10. Igniter as defined in claim 8, wherein said element is of synthetic plastic foil material.

11. Igniter as defined in claim 8, wherein said element is of metallic material.

* * * * *